US008863566B2

(12) United States Patent
Weigelt

(10) Patent No.: US 8,863,566 B2
(45) Date of Patent: Oct. 21, 2014

(54) TOOL FASTENING DEVICE FOR A WEDGE DRIVE

(76) Inventor: Elke Weigelt, Kürten (DE)

( * ) Notice: Subject to any disclaimer, the term of this patent is extended or adjusted under 35 U.S.C. 154(b) by 1440 days.

(21) Appl. No.: 11/993,841

(22) PCT Filed: Jun. 22, 2006

(86) PCT No.: PCT/EP2006/005993
§ 371 (c)(1),
(2), (4) Date: Nov. 4, 2008

(87) PCT Pub. No.: WO2006/136404
PCT Pub. Date: Dec. 28, 2006

(65) Prior Publication Data

US 2009/0173135 A1 Jul. 9, 2009

(30) Foreign Application Priority Data

Jun. 23, 2005 (DE) ..... 10 2005 029 140

(51) Int. Cl.
*B21J 9/18* (2006.01)
*B21D 11/00* (2006.01)
*B21D 28/32* (2006.01)
*B21D 19/08* (2006.01)

(52) U.S. Cl.
CPC ..... *B21D 28/32* (2013.01); *B21D 19/08* (2013.01)
USPC ..... 72/452.9; 72/315

(58) Field of Classification Search
CPC ..... B21D 28/32; B21D 19/08
USPC ..... 72/452.9, 452.8, 315, 304
See application file for complete search history.

(56) References Cited

U.S. PATENT DOCUMENTS 4,515,049 A 5/1985 Dietz et al.
5,101,705 A * 4/1992 Matsuoka ..... 72/452.9

(Continued)

FOREIGN PATENT DOCUMENTS

DE 198 60 178 C1 5/2000
EP 0484588 5/1992

(Continued)

*Primary Examiner* — Shelley Self
*Assistant Examiner* — Mohammad I Yusuf
(74) *Attorney, Agent, or Firm* — Knobbe, Martens, Olson & Bear, LLP

(57) ABSTRACT

The invention relates to an upper part V-belt drive (1) with a tool fastening device (10, 200, 300, 400) having at least one lateral surface (19), which can be provided with a tool, and the V-belt drive (1) has a slider element (2, 420) and a driver element (3, 430). According to the invention, the tool fastening device (10, 200, 300, 400) is fastened in a manner that enables it to be removed downward with regard to the upper part V-belt drive (1) when in the working position thereof. In a tool fastening device (10, 200, 300, 400) for a V-belt drive (1) with a slider element (2, 420) and with a driver element (3, 430), the tool fastening device (10, 200, 300, 400) comprises at least one lateral surface (19), which can be provided with a tool, and the tool fastening device (10, 200, 300, 400) has at least one connecting device (11, 14, 22, 213, 214, 215, 219, 313, 314, 316, 317, 318, 319, 408, 409, 410, 411, 414) for positively and or non-positively connecting with the slider and driver element.

20 Claims, 9 Drawing Sheets

(56) References Cited

U.S. PATENT DOCUMENTS

Figure 1:
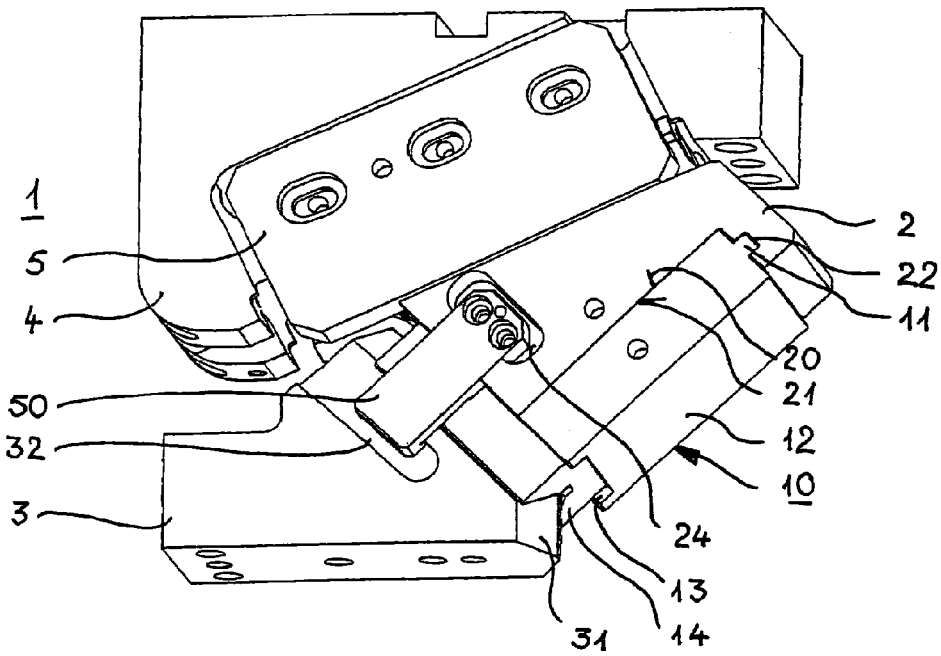

| | | | | |
|---|---|---|---|---|
| 5,149,071 | A | 9/1992 | Oliveira | |
| 5,197,834 | A | 3/1993 | Chase et al. | |
| 5,269,167 | A * | 12/1993 | Gerhart | 72/452.9 |
| 5,487,296 | A | 1/1996 | Gerhart et al. | |
| 5,551,795 | A | 9/1996 | Engibarov | |
| 5,904,064 | A | 5/1999 | Higuchi | |
| 6,126,159 | A | 10/2000 | Dornfeld | |
| 6,978,651 | B2 | 12/2005 | Fidziukiewicz | |
| 6,990,844 | B1 * | 1/2006 | Fidziukiewicz | 72/452.9 |
| 7,013,783 | B2 | 3/2006 | Matsuoka | |
| 7,114,364 | B2 | 10/2006 | Weigelt | |
| 7,191,635 | B2 | 3/2007 | Chun | |
| 7,431,502 | B2 * | 10/2008 | Fidziukiewicz | 72/452.9 |
| 8,573,024 | B2 * | 11/2013 | Lanksweirt | 72/452.9 |
| 8,689,600 | B2 * | 4/2014 | Weigelt | 72/452.9 |
| 2004/0025561 | A1 | 2/2004 | Weigelt | |
| 2005/0262920 | A1 | 12/2005 | Fidziukiewicz | |
| 2006/0101894 | A1 | 5/2006 | Chun et al. | |
| 2009/0078067 | A1 | 3/2009 | Weigelt | |
| 2011/0167954 | A1 * | 7/2011 | Shibata et al. | 74/567 |

FOREIGN PATENT DOCUMENTS

| | | | |
|---|---|---|---|
| EP | 1035965 | B1 | 8/1998 |
| EP | 1259371 | B1 | 12/1999 |
| EP | 1197319 | B1 | 10/2000 |
| EP | 1362 651 | A1 | 11/2003 |
| JP | 04-138825 | | 5/1992 |
| JP | 11-347654 | A | 12/1999 |
| JP | 2001-1046 | | 1/2001 |
| JP | 2005-246410 | A | 9/2005 |
| KR | 20-1996-0020727 | | 7/1996 |
| KR | 10-2001-0071791 | | 7/2001 |
| KR | 20-0265751 | | 2/2002 |
| WO | WO 99/28117 | | 6/1999 |
| WO | WO 00/02680 | | 1/2000 |
| WO | WO 00/38907 | | 7/2000 |
| WO | WO 02/30659 | | 4/2002 |
| WO | WO 2006/036381 | A2 | 4/2006 |
| WO | WO 2006/136404 | A1 | 12/2006 |

* cited by examiner

TOOL FASTENING DEVICE FOR A WEDGE DRIVE

CROSS REFERENCE TO RELATED APPLICATIONS

This application claims the benefit and priority to and is a U.S. National Phase of PCT International Application Number PCT/EP2006/005993, filed on Jun. 22, 2006, which claims priority to German Patent Application No. DE 10 2005 029 140.6 filed on Jun. 23, 2005. The disclosures of the above-referenced application is hereby expressly incorporated by reference in its entirety.

The invention concerns an upper part wedge drive or cotter key with a tool fastening device having at least one lateral surface which can be provided with a tool, wherein the wedge drive has a slider element and a driver element as well as a tool fastening device for such a wedge drive.

A wedge drive serves for diverting perpendicularly acting forces of a press which is used for the production of sheet metal shaped parts, in particular bodywork parts, into any direction which differs from the vertical. It is precisely in the production of bodywork parts that the component geometries which involve undercut configurations and other irregularly shaped regions mean that the problem arises that they cannot be worked upon with presses or stamping machines which stamp or press in a perpendicular direction, so that wedge drives have to be used for that purpose. Such wedge drives substantially comprise a slider guide element or guide bed, a driver element or driver wedge and a slider element or carriage which, by way of the other two elements, transmits the direction of the pressing force, which is diverted by virtue of the wedge shape. A wedge drive can be arranged in the upper part or in the lower part of a pressing tool, depending on the respective situation of use. The action thereof is the same in both cases, namely diverting the forces produce by the pressing tool, into a direction which differs from the vertical. Usually, the degree of deflection of the pressing force decides whether the wedge drive is arranged in the lower part or in the upper part of the pressing tool. A diversion of up to 20° relative to the sole of the pressing tool (horizontal) is generally provided by wedge drives in the lower part of the pressing tool whereas greater degrees of deflection are generally effected by the provision of wedge drives in the upper part of the pressing tool, in favor of an improved option in terms of removing the bodywork parts from the pressing tool. The degree of diversion otherwise depends on the working operation which is to be carried out by the pressing tool, in which respect wedge drives are used in particular when piercing through openings, cutting partial regions of a body to bending over and post-forming undercut portions which cannot be reached from above or below.

The wedge drive is thus only an implementing member of a pressing tool and serves to drive for example an aperturing punch, a cutting blade or a shaping jaw in the pressing tool. In that case the wedge drive itself usually does not touch the workpieces. Touching contact or engagement into the bodywork parts is only effected by the tools which are fixed to the wedge drive (punch, cutting blade, shaping jaw and so forth). The tools are each appropriately adapted to the inclination of the wedge drive in order to permit the inclinedly oriented machining of the workpiece. By virtue of the inclinedly oriented structure, this configuration not only gives rise to manufacturing problems but also increased production costs. That can also already be seen from the fact that, upon first construction and when changing the stamping and shaping standardized components, the entire wedge drive has to be dismantled. In many cases however that is possible only with very great difficulty as the carriage of a driver wedge, by virtue of its non-angled external shape, can be only poorly gripped in a vise etc. Thus fitting machining tools can frequently only be effected at very high and disproportionate cost.

In order to resolve that problem, tool fastening devices have been developed, which can be fastened to the slider element of the wedge drive so that the cutting and shaping tools can also be pre-assembled with machining tools, outside the wedge drive and the pressing tool, so that the operation of changing the tools can be effected quickly and without any problem.

Such a tool fastening device is disclosed for example in DE 198 60 178 C1. That tool fastening device which is referred to as a mounting plate is dismantled by way of fastening screws which are accessible from behind, which means that it can only be dismantled when the slider element is displaced upwardly to such an extent that it is accessible from behind, that is to say from the driver element. The tool fastening device is in the form of right-angled plate and is arranged on the front side of the slider element and is supported there downwardly in the direction to the slider guide towards the driver element by a step. The tool fastening device also has a T-shape groove in order to transmit lateral thrusts to the carriage.

Tool fastening devices of that kind enjoy the great advantage that a change of worn tools and also initial construction in mass production are considerably facilitated as only a small part of the wedge drive, namely the tool fastening device, needs to be dismantled and removed from the pressing tool, together with the tool which is to be replaced. That operation replaces time-consuming and generally highly complicated and expensive complete dismantling of the entire wedge drive, which is usually quite labor-intensive because of the often severely constricted space circumstances in a pressing tool and the poor accessibility to the wedge drive. It will be noted however that it is necessary for the tool fastening device to satisfy the high demands in terms of the tolerance and the forces which occur within a pressing tool, which inter alia means that the tool fastening device may not automatically come loose and also laterally occurring-thrust forces have to be absorbed. In addition it should be easily accessibly and reproducibly accurately assembled and dismantled in order to satisfy the high demands in terms of accurate positioning of the tools on the wedge drive. As wedge drives generally transmit forces of several hundred tons, it is necessary for the tool fastening device to be securely and firmly carried on the wedge drive in the forward drive movement, that is to say the working procedure, without flexural deflection. In the return movement the tool fastening device may also once again neither bend nor be torn away from the wedge drive or be pulled out of its position, even if a tool fastened thereto comes into hooking engagement in the respective workpiece in the stamping or shaping operation, and thereby gives rise to a resistance which has to be overcome in the withdrawal movement. In general return forces of between 10 and 15 percent of the working force occur, that is to say also not inconsiderable forces which the tool fastening device must be capable of withstanding.

In accordance with DE 198 60 178 C1 the mounting plate can be dismantled by way of fastening screws which are accessible from behind, wherein the fastening screws are arranged in a horizontal direction, that is to say in the working direction of the wedge drive. If the mounting plate were arranged perpendicularly or at least inclinedly relative to the working direction of the wedge drive, the fastening screws would have to be of really large dimensions, which is generally scarcely possible by virtue of the very constricted space conditions in a pressing tool.

With a tool fastening device, it was intended to be possible to avoid burr formation and unnecessary wear of the machining tools, in which respect the tolerance or reproduction accuracy in terms of positioning of the tool fastening device should be at a maximum 0.02 mm. Usually such slight tolerances cannot be achieved with the known tool fastening devices, not even with that in accordance with DE 198 60 178 C1.

Therefore the object of the present invention is to provide an upper part wedge drive or cotter key having a tool fastening device as well as a tool fastening device for such a wedge drive, wherein the aforementioned prerequisites in regard to reproduction accuracy and tolerances are met, so that an operator can reduce his manufacturing costs and maintenance expenditure, wherein the tool fastening device can be easily dismantled from the wedge drive, but upon assembly can be positioned in reproducibly accurate fashion on the wedge drive and fastened thereto, is itself stable and also fits in an accurate position in operation in relation to the high forces in pressing use.

That object is attained for an upper part wedge drive as set forth in claim 1 in that the tool fastening device is fastened dismantleably downwardly in relation to the upper part wedge drive in the working position thereof. For a tool fastening device for such a wedge drive the object is attained in that the tool fastening device has at least one connecting device for connection in positively locking and/or force-locking relationship to the slider and driver elements. Developments of the invention are defined in the appendant claims.

That therefore provides an upper part wedge drive in which the possibility of dismantling the tool fastening device downwardly in relation to the upper part wedge drive in the working position thereof affords the great advantage that good accessibility is afforded, and for example access is not rendered more difficult due to components such as a stamping or cutting die. More difficult accessibility to the fastening means represents a problem for example in DE 198 60 178 C1, which however that publication cannot resolve.

The tool fastening device according to the invention for a wedge drive which is connected both to the slider element and also the driver element in positively locking and/or force-locking relationship makes it possible for loss of positioning during operation of the wedge drive to be substantially prevented. In addition it is possible for the reproduction accuracy in terms of assembly of the tool fastening device, even after change thereof or after a change in the tool which is fastened thereon, to be kept in the desired minimum range of less 0.02 mm. The fact that the tool fastening device is connected both to the slider element and also the driver element in positively locking and/or force-locking relationship provides for support and positioning in at least two directions, whereby the desired positional accuracy can be achieved. By virtue of the possibility of being able to dismantle the tool fastening device at an angle substantially perpendicularly to the working direction of the wedge drive in the direction of the opened wedge drive, that affords better accessibility to the one or more fastening means with which the tool fastening device is fastened to the wedge drive. In the case of the arrangement in accordance with DE 198 60 178 C1 the slider and the driver first have to be moved very far away from each other in order to be able to release the mounting plate from the slider and remove it. The advantageous possibility of being able to remove the tool fastening device from the wedge drive without the driver element and the slider element being moved completely away from each other in that way not only permits an easier change but also affords a cost saving as the operation of changing the tool fastening device can take place more quickly than is possible in the state of the art.

In the meantime the use of mass-produced standard wedge drives has become frequently widespread, which signifies for the purchaser that he can obtain from stock a wedge drive which is in a finished worked condition as standard. Only the fastening bores of the respective and cutting and shaping tools, that is to say working tools, still have to be individually produced by the purchaser. That means therefore that the purchaser has to completely dismantle the wedge drive which is in its finished assembled condition, in order to specifically work thereon, on his own working apparatus, for the respective area of use, that is to say in order to be able to provide on the wedge drive in particular suitable fastening bores for the working tools. In principle he can here admittedly also have recourse to a mounting plate in accordance with DE 198 60 178 C1, whereby his expenditure and complication is certainly already reduced, as that mounting plate is in the form of a substantially flat plate with mutually parallel surfaces which can be satisfactorily clamped in a working apparatus. It will be noted however that that mounting plate cannot be assembled completely without any problem to any standard wedge drive and removed therefrom. In contrast, the assembly complication and expenditure with the tool fastening device according to the invention which in comparison can be very easily fitted to and removed from a wedge drive, can be reduced by 80%. As the tool fastening device according to the invention preferably has at least one surface substantially parallel to the at least one lateral surface which can be provided with a working tool, the tool fastening device according to the invention is very suitable for subsequent working thereof as by virtue of that configuration it can be substantially more easily gripped in a vise and so forth of a working apparatus, than a body of a carriage or slider element, which is of a non-right-angled and generally oddly shaped configuration. The mounting plate of DE 198 60 178 C1 admittedly already enjoys the advantage that it can be easily gripped. In comparison therewith the tool fastening device according to the invention has the great advantage that the connecting devices thereof, which permit a connection in positively locking and/or force-locking relationship both to the slider element and also to the driver element, permit a secure connection to both elements and thus provide for positioning and holding thereof in relation to tilting and displacement in various directions.

The provision of the tool fastening device according to the invention gives considerable cost advantages in regard to manufacture and maintenance of a wedge drive, in which respect for example the overall operating and first working costs can be reduced to below 50% over the manufacturing period which is covered with a wedge drive. It is precisely the operating and first working costs that can otherwise amount to a multiple of what a wedge drive costs overall in regard to purchase thereof.

Preferably the connecting device for making the positively locking connection is a tongue-and-groove connection. It is possible without any problem to maintain given positioning even under high pressing forces, by virtue of the provision of such a tongue-and-groove connection or a plurality of such connections over the tool fastening device. It is precisely also in the advance movement that flexural deformation of the tool fastening device can be avoided in that case as the tongue-and-groove connection can also be optimally subjected to the effect of increased pressure forces and, by virtue of the positively locking connection, the tool fastening device does not deflect in that case but acts as a unit with the wedge drive. In the return movement of the machining tool out of the workpiece, in which otherwise the machining tool can easily come into hooking engagement in the workpiece and can thus give rise to a resistance force in opposition to the withdrawal movement, a positively locking connection such as a tongue-and-groove connection is also found to be particularly advantageous as in that case also the tool fastening device remains stably in its positioning on the wedge drive.

Preferably the connecting device for force-locking connection includes at least one guide prism provided on one side of the tool fastening device and/or a prismatic recess. Particularly preferably the at least one guide prism and/or the at least one prismatic recess are formed integrally with the main body of the tool fastening device. Alternatively the at least one guide prism is in the form of a separate element and is or can be connected to the main body of the tool fastening device. Particularly preferably the at least one guide prism and the main body of the tool fastening device can be connectable or connected to each other by fastening means, in particular screws. The provision of a guide prism as the connecting device for connection in particular to a driver element of the wedge drive makes it advantageously possible to provide support for the tool fastening device on the driver element during the movement when working on a workpiece, that is to say in the advance movement and in the return movement.

The way in which the guide prism is connected to the tool fastening device, whether it is integral therewith or only joined thereto, can be made dependent on the respective structural size of the wedge drive and the rest of the construction thereof. The guide prism can be of a block-like nature in the form of an element provided with a prismatic sliding surface adapted to the driver element, or it can be of a sliding plate-like configuration. Alternatively the arrangement may have only one prismatic recess. The respective configuration can be made dependent on the forces which are to be carried. An integral configuration of the tool fastening device and the guide prism is suitable in particular in the case of smaller wedge drives, whereas making the guide prism in the form of a separate element is particularly suitable in the case of medium-size and large wedge drives, in which case also the guide prism may be only in the form of a narrow plate element or in the form of a compact component, also in each case depending on the size of the wedge drive, that is to say also the forces which occur when working on a workpiece.

In order not to represent an impediment in terms of the sliding movement on the driver element, the guide prism can advantageously be provided with fastening means which are arranged in the longitudinal direction of the tool fastening device and at least partially sunk in the guide prism body. To dismantle the guide prism from the tool fastening device, the slider element is merely displaced in the workpiece working direction, in which case then the corresponding fastening means are accessible from below in the case of the upper part wedge drive in the working position thereof so that dismantling of the tool fastening device can be effected without any problem. Advantageously in that case the tool fastening device can be dismantled at an angle perpendicularly to the working direction of the wedge drive, in the direction of the opened wedge drive, upon assembly or dismantling downwardly in relation to the working position of an upper part wedge drive. The approximately perpendicular angle relative to the working direction of the wedge drive affords easy accessibility upon assembly and dismantling of the tool fastening device.

Preferably the wedge drive designed in accordance with the invention has at least one portion which faces towards the tool fastening device and which, for carrying return movement forces, has at least one connecting device for positively lockingly and/or force-lockingly connecting to the tool fastening device. Preferably such a connecting device for positively locking connection is a tongue-and-groove connection which is particularly preferably provided on the side of the tool fastening device, which is in opposite relationship to the guide prism. By virtue of that arrangement, after assembly of the tool fastening device, the part which forms the positively locking connection is pressed into the desired position and holds fast therein without an additional fastening being required, for example by way of screws and so forth. Nonetheless, on the side towards which it is removable from the wedge drive, the tool fastening device can be fixed to the wedge drive by way of at least one fastening means in particular a screw. That however is not absolutely essential as, after positioning of the tool fastening device, between the slider and driver elements, it fits in positively locking and force-locking relationship.

To carry higher mass acceleration forces, there is preferably provided at least one lateral holding bar element which extends beyond the region of the at least one guide prism to the driver element. In a particularly preferred feature the at least one holding bar element engages laterally at or under the driver element. It has proven to be advantageous if the at least one holding bar element extends between the slider element and the driver element, and in particular is fixed to the slider element. Such a holding bar element also permits fixing of the tool fastening device in a lateral direction, that is to say in the direction in which the positively locking connection does not afford a hold, at least if it is in the form of a tongue-and-groove connection which is oriented only in one direction. The provision of a guide prism admittedly in principle affords the desired hold in that lateral direction. It will be noted however that it is precisely in relation to high mass acceleration forces that occur, that it is advantageous, in addition to the stable guide prism, for it also to be fixed laterally to the slider element, by way of the holding bar elements. The fact that the at least one holding bar element only fixes the slider element and the driver element laterally relative to each other further permits a movement in the longitudinal direction of the driver element, that movement therefore not being prevented by the holding bar elements. For that purpose the at least one holding bar element is of a suitable configuration which permits engagement on the driver element but is not secured thereto. Fastening of the holding bar element is preferably effected on the slider element as the slider element slides on the driver element. In principle it is also possible to fasten a holding bar element to the driver element and for a holding bar element to extend over the surface of the slider element and to be caused to slide along same, in particular at a recess or groove which is provided there and which can possibly also be extended into the surface of the tool fastening device.

Preferably there are provided one or more holding noses for the transmission of forces upon withdrawal of the slider element, which are hookable to or latchable in the driver element. Latching engagement is preferably effected in a corresponding groove or recess in the driver element, in which case movement of the slider element along the driver element is allowed.

Figure 2:
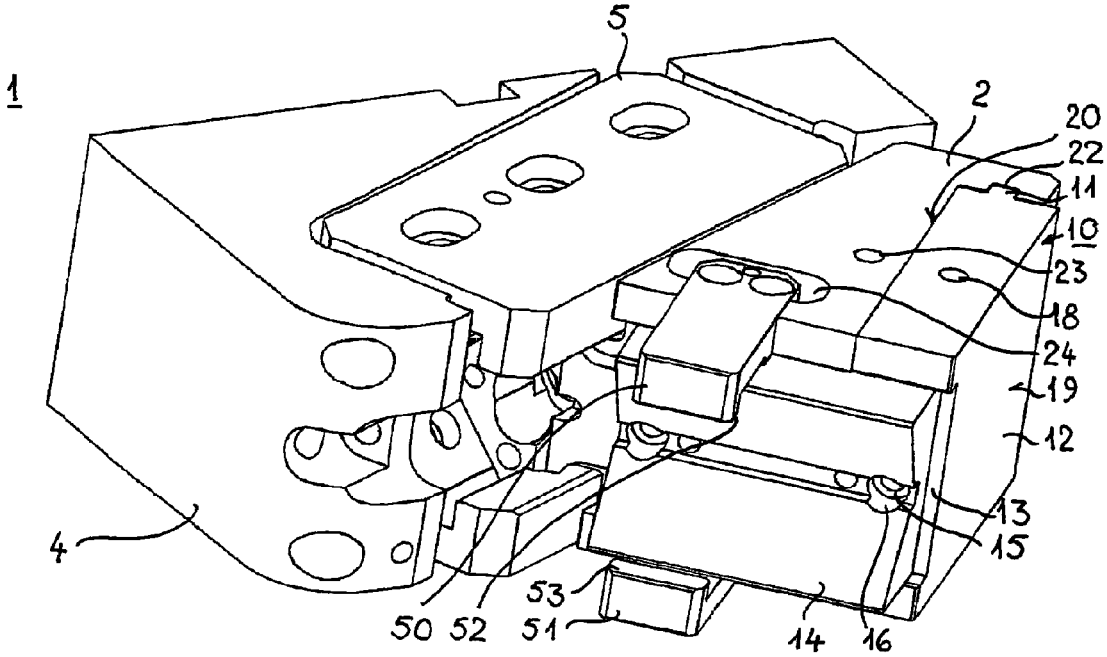
Figure 3:
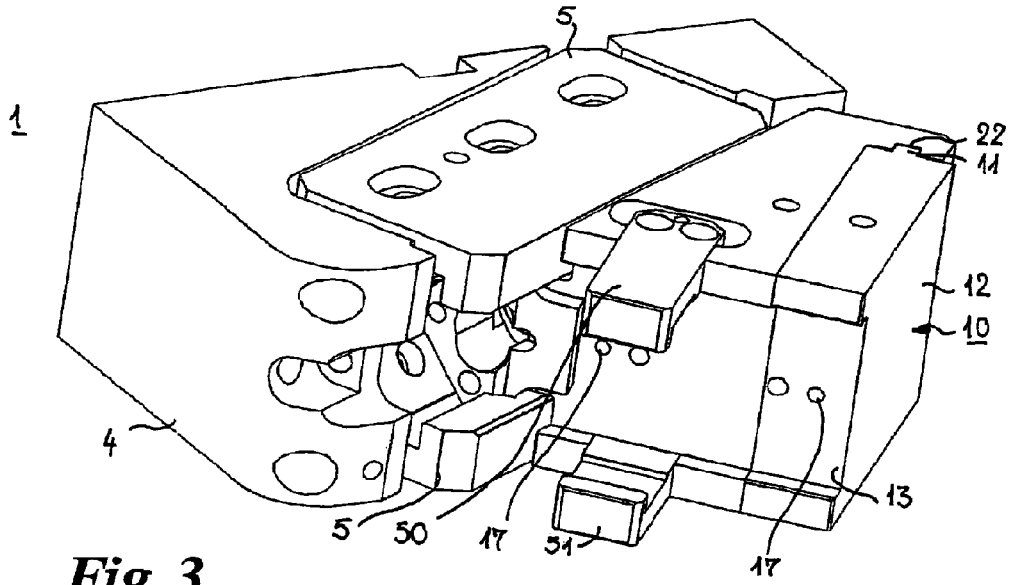
Figure 5:
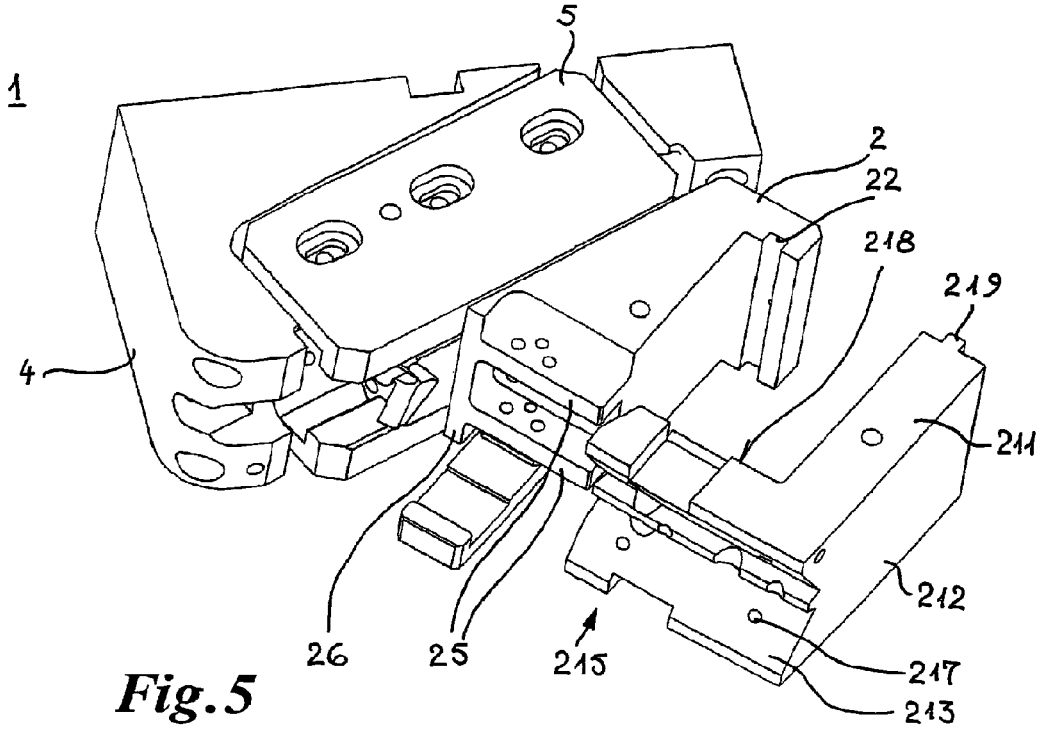
Figure 4:
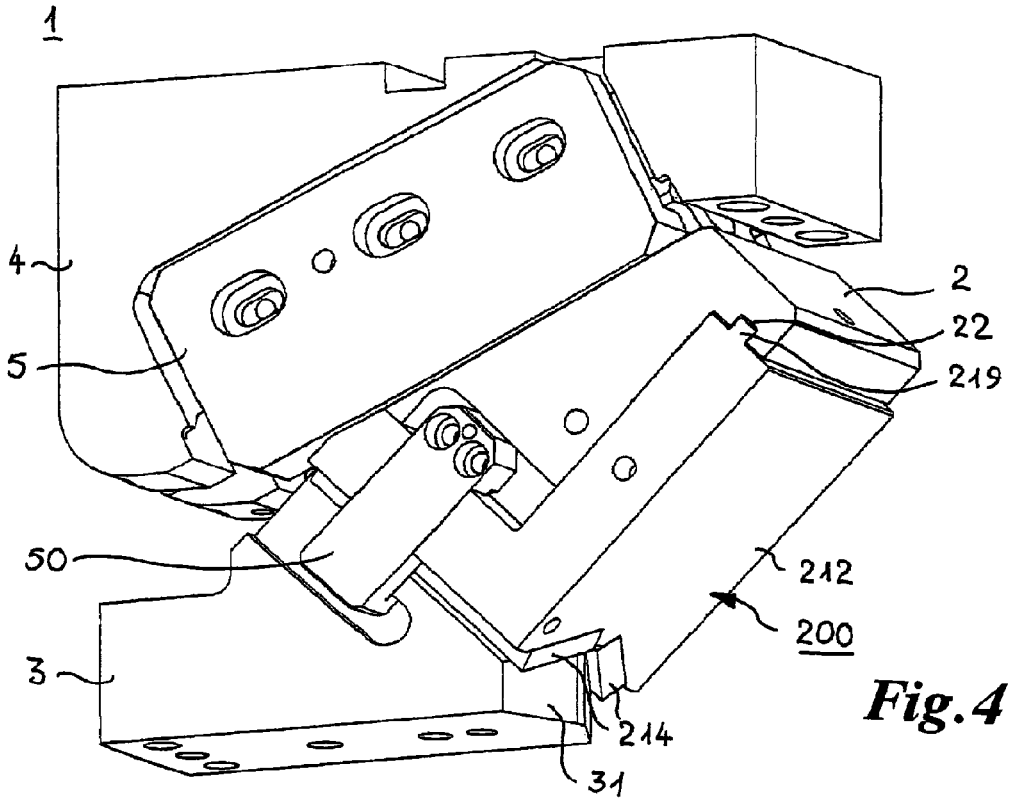
Figure 6:
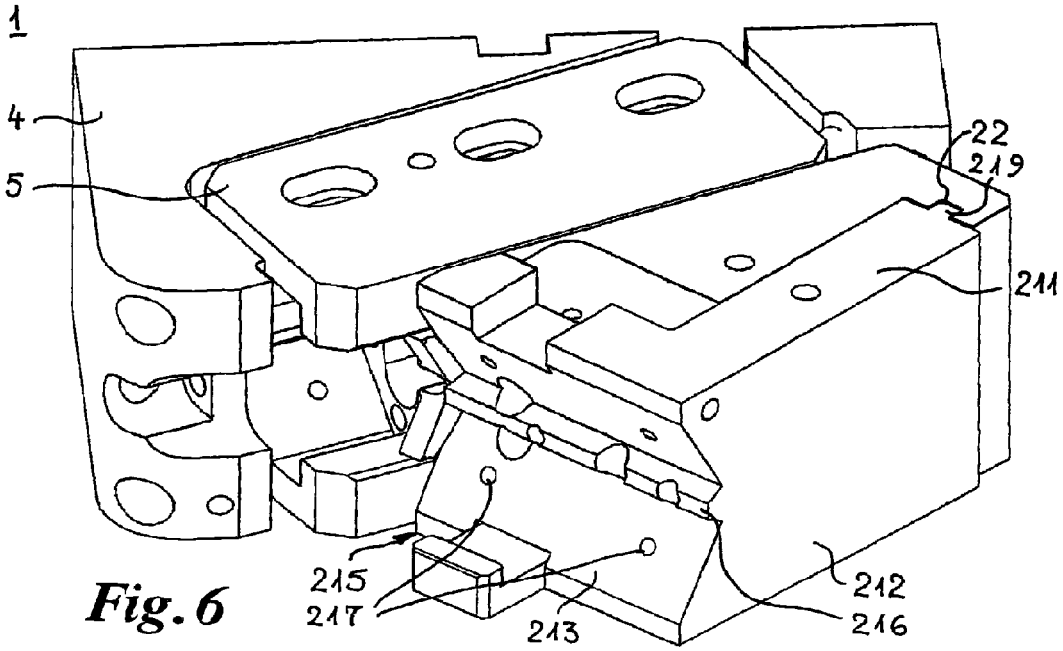
Figure 7:
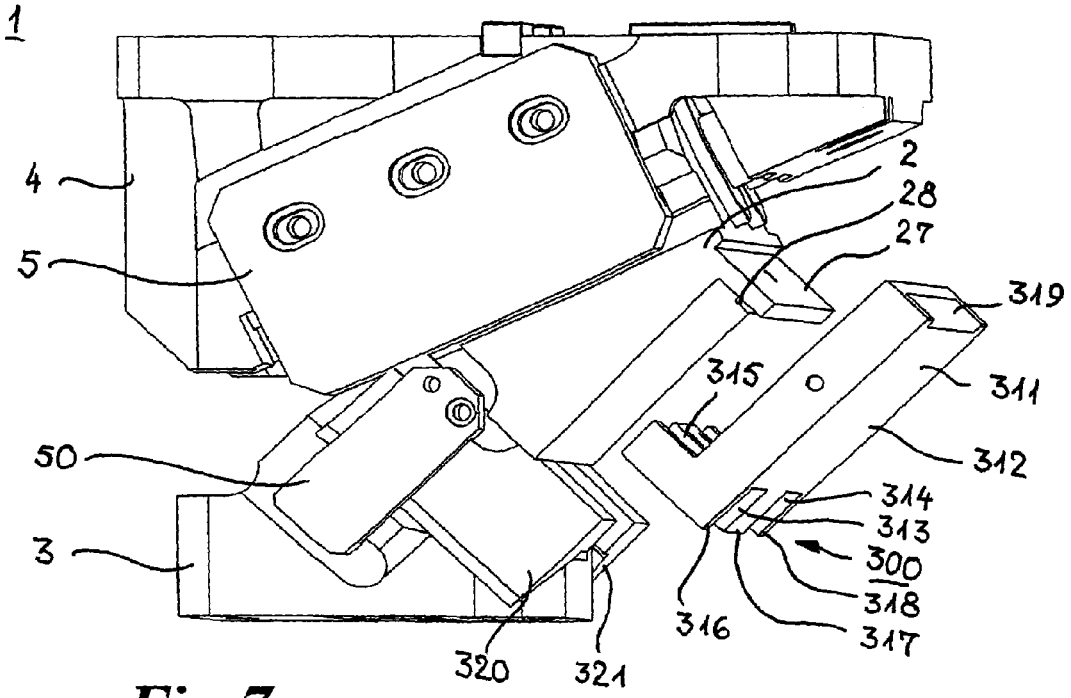
Figure 8:
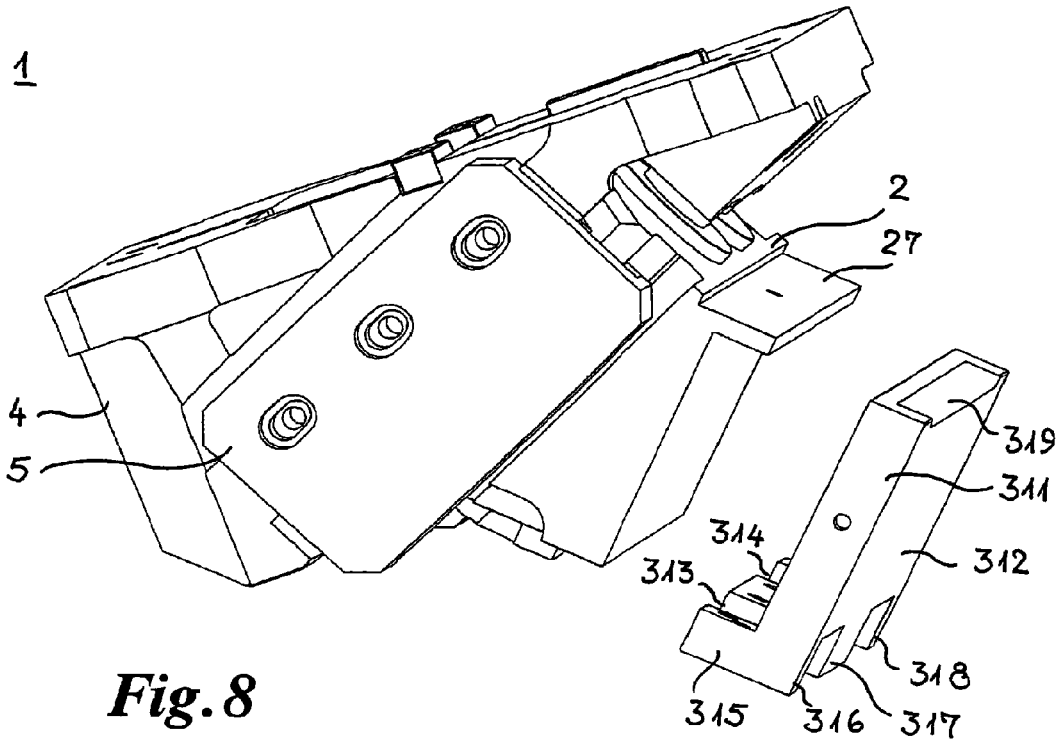
Figure 9:
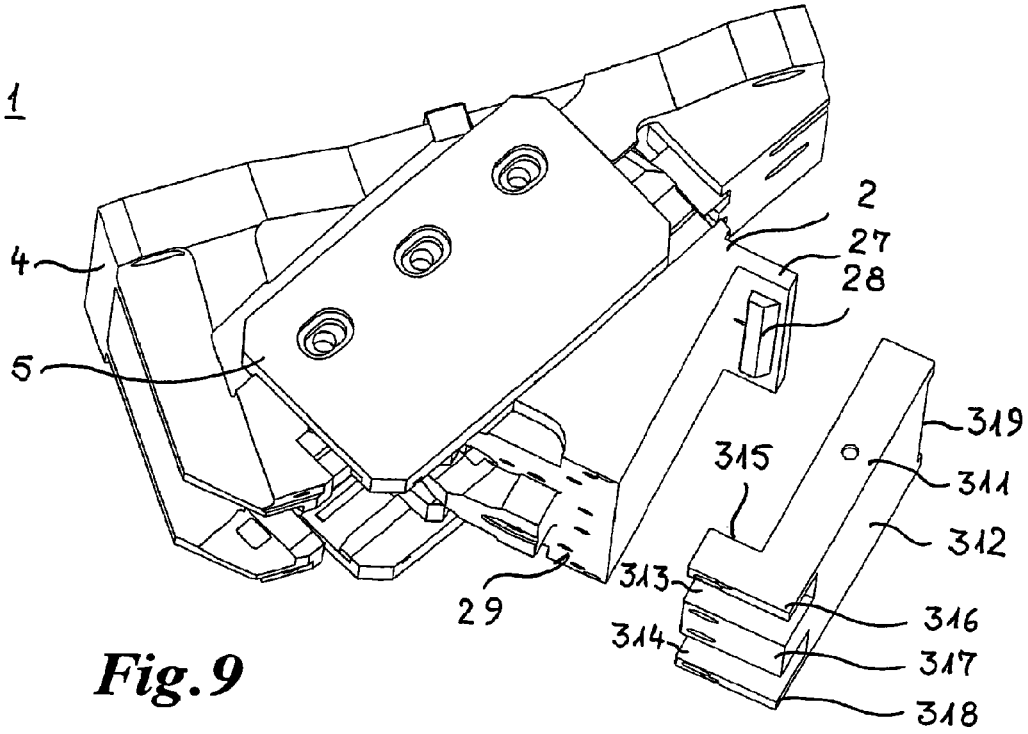
Figure 10:
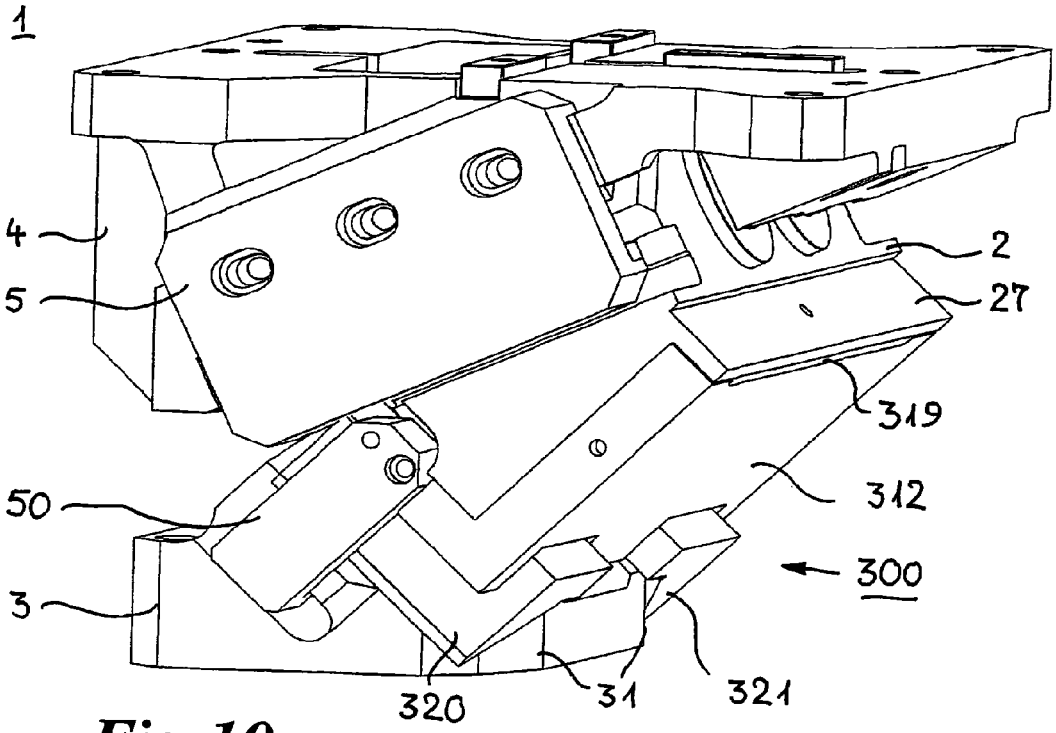
Figure 12:
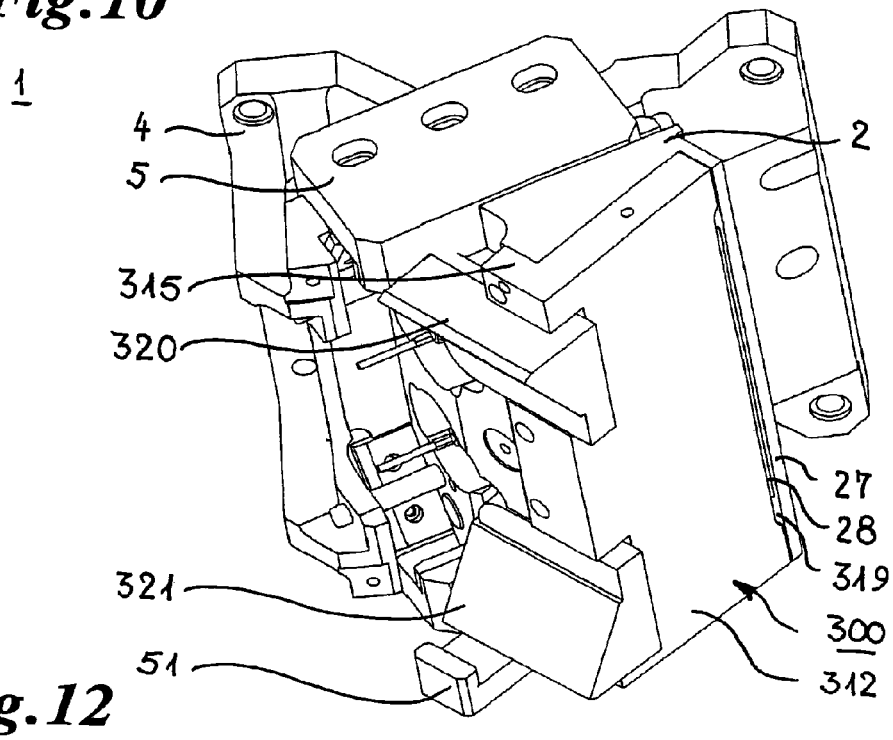
Figure 11:
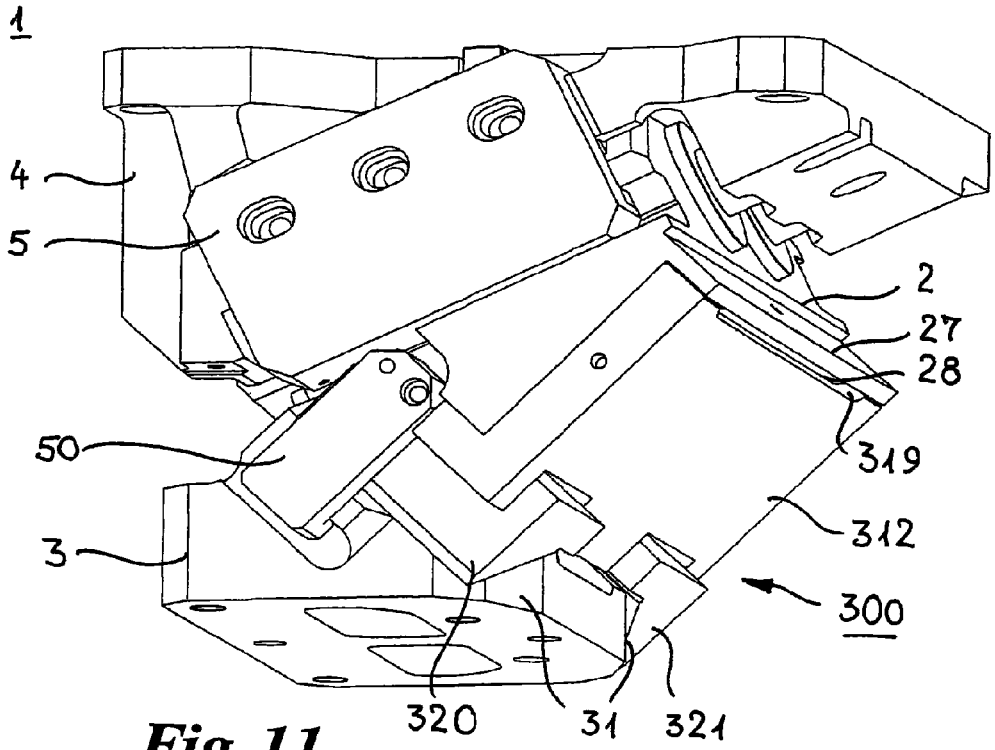
Figure 14:
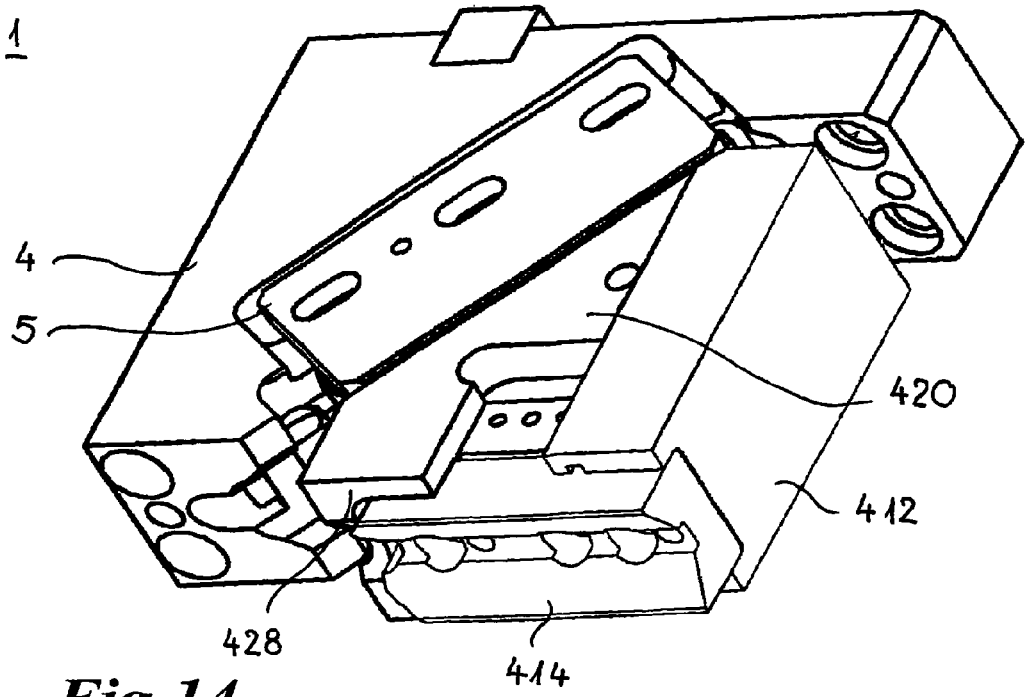
Figure 13:
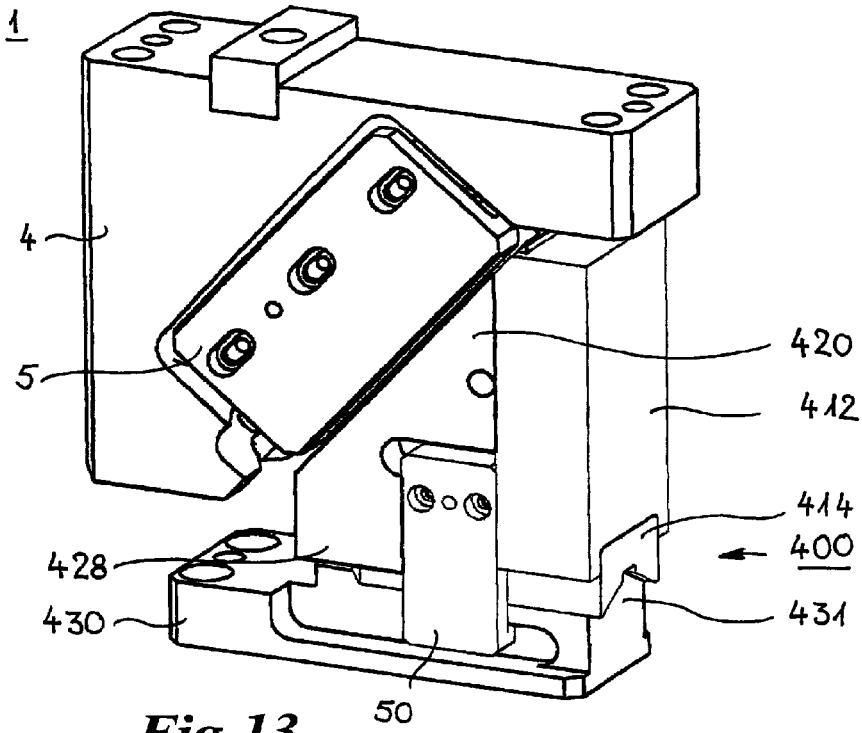
Figure 17:
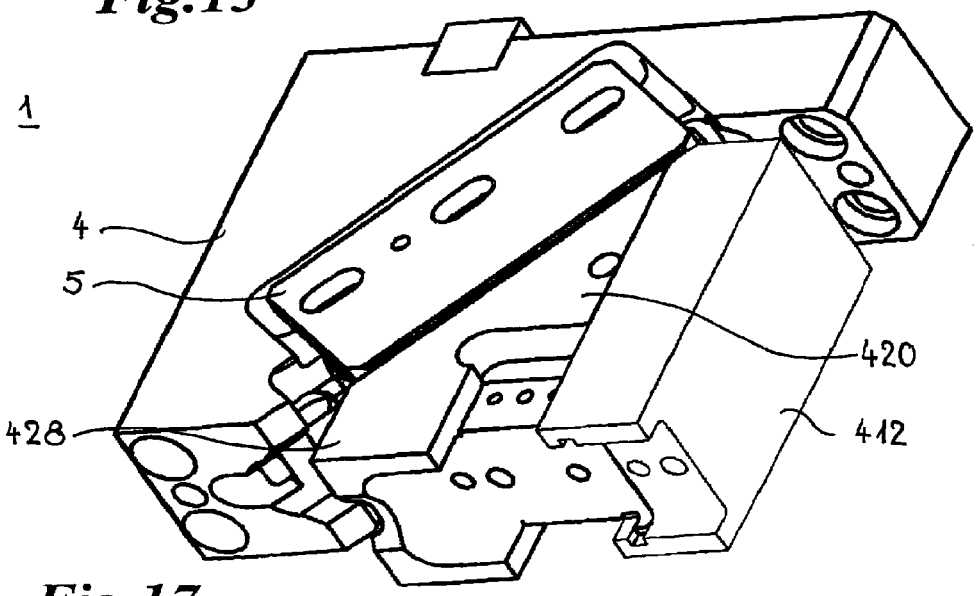
Figure 15:
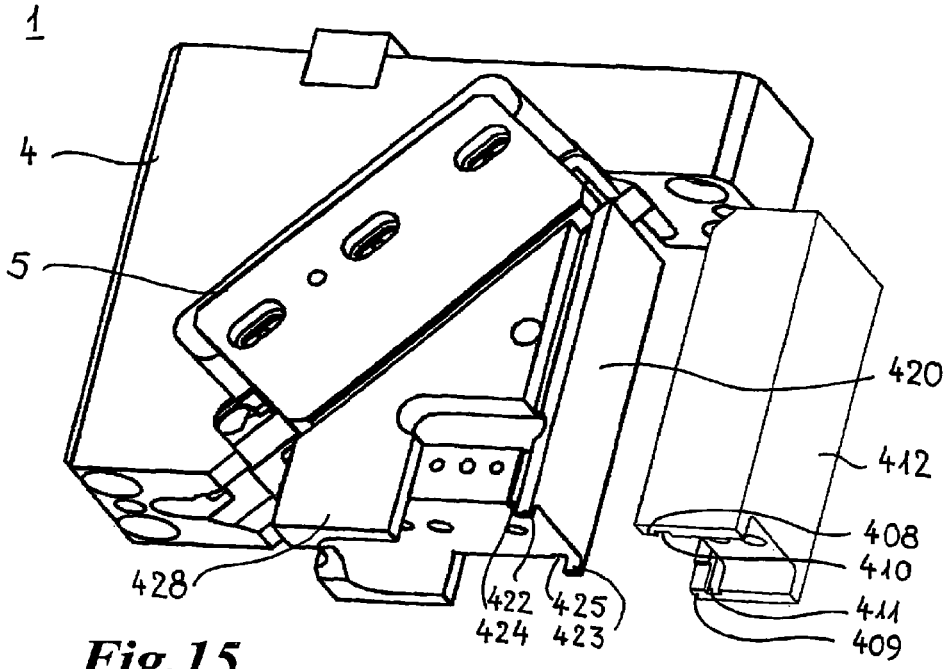
Figure 16:
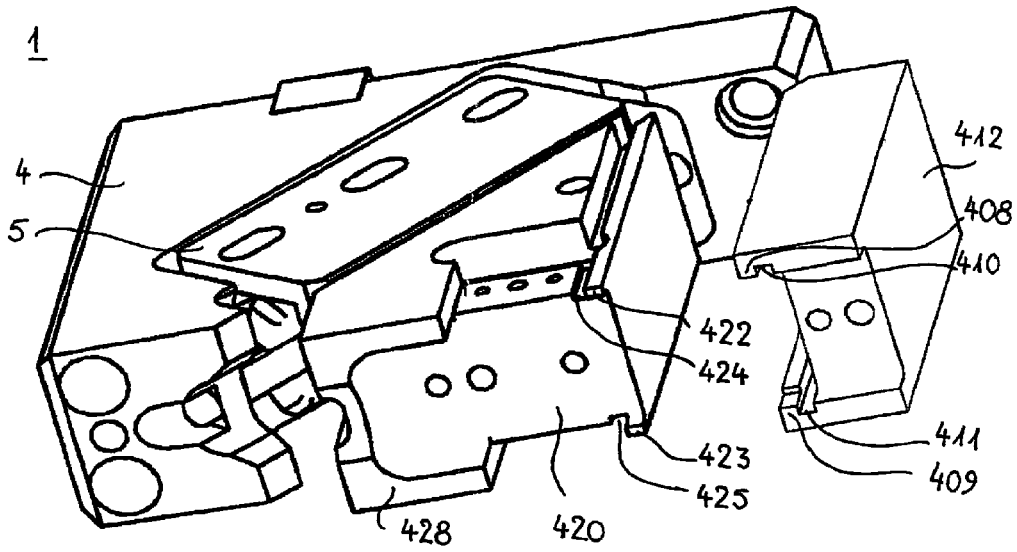

To set forth the invention in greater detail embodiments by way of example are described more fully hereinafter with reference to the drawings in which:

FIG. 1 shows a perspective view of a wedge drive with a tool fastening device according to the invention, FIG. 2 shows a perspective view from below of the tool fastening device shown in FIG. 1, FIG. 3 shows a perspective view of the tool fastening device of FIG. 1 and FIG. 2 without a guide prism, FIG. 4 shows a perspective view of a wedge drive with a tool fastening device according to the invention in a second embodiment with sliding plates, FIG. 5 shows an exploded perspective view from below of the wedge drive with tool fastening device as shown in FIG. 4, FIG. 6 shows a perspective view of the wedge drive of the FIG. 5 with tool fastening device with prismatic recess, without sliding plates, FIG. 7 shows a perspective view of an upper part wedge drive with a third embodiment of a tool fastening device according to the invention, FIG. 8 shows a partly exploded perspective view of a part of the upper part wedge drive shown in FIG. 7, FIG. 9 shows a perspective view of the upper part wedge drive of FIG. 8 in a direction viewing from below, FIG. 10 shows a perspective view of an upper part wedge drive with a fourth embodiment of a tool fastening device according to the invention, FIG. 11 shows a perspective view of the upper part wedge drive of FIG. 10 in a direction viewing from below, FIG. 12 shows a perspective view of a part of the upper part wedge drive shown in FIG. 10, FIG. 13 shows a perspective view of an upper part wedge drive with a fifth embodiment of a tool fastening device according to the invention, FIG. 14 shows a perspective view from below of a part of the upper part wedge drive shown in FIG. 13, FIG. 15 shows a partial exploded perspective view of the upper part wedge drive of FIG. 14 without guide prism, FIG. 16 shows a perspective view from below of the partial exploded view of FIG. 15, and FIG. 17 shows a perspective view of the part of the upper part wedge drive shown in FIGS. 15 and 16, in the assembled position.

FIG. 1 shows a perspective view of a first embodiment of a tool fastening device 10 in an assembled condition on a wedge drive 1 or cotter key. The wedge drive has a slider element 2, a driver element 3 and a slider guide element 4, wherein the slider guide element 4 and the slider element 2 are held together by way of a guide clamp 5. The tool fastening device 10 is supported on the slider element 2 on the front side 21 thereof, with its rearward side 20. The tool fastening device 10 is connected in positively locking relationship to the slider element 2 by way of a tongue-and-groove connection 11, 22. In that case the tool fastening device 10 has a projecting element 11 and the slider element 2 has a groove 22. The projecting element of the tool fastening device 10 engages into the groove 22 in positively locking relationship.

On its side directed towards the driver element 3 the tool fastening device 10, in its main body 12, has a recess 13 into which a guide prism 14 is fitted. The guide prism 14 is mounted slidably on a driver prism 31 of the driver element.

A tool can be fastened at the front face 19 of the tool fastening device, at a location which is selected in use-specific fashion. Fastening can easily be effected prior to assembly of the tool fastening device to the slider element.

As can be seen from FIG. 2 the main body 12 and the guide prism 14 are connected together by way of screws 15 which are fitted into corresponding through openings 16, 17 in the guide prism and in the main body 12. As can also be seen from FIG. 2, a respective screw 15 is also provided directly in the guide prism 14 for fixing it to the slider element and correspondingly an opening 16, 17 is also provided in the guide prism 14 and the slider element 2. The fact that the guide prism 14 extends substantially over the entire overlap surface of the slider element and the driver element makes it possible not only to provide for particularly good support for the slider element with its main body 12 in relation to the driver element, but also permits a particularly good firm seat on the driver element.

In order to guarantee an even better fit for the slider element and the driver element to each other precisely in the case of large wedge drives in which high mass accelerations can occur during operation, or as a positive return device, holding bars 50, 51 are provided at both sides on the slider element 2. The holding bars respectively engage over the guide prism 14 and are supported on the driver element 3, as can be seen from FIGS. 1 and 3. Provided on the slider element for arranging the holding bars are respective recesses 24, wherein the holding bars are fastened therein by way of screws, as only indicated in FIG. 1. For that purpose the holding bars in that region have bores and recesses to countersink the screw heads so that the risk of them being cut off when installing the wedge drive does not arise.

The holding bars engage with projecting ends 52, 53 (FIGS. 2 and 3) which are in the form of holding noses, into a corresponding recess or into a region 32 of suitable configuration, of the driver element. By virtue thereof, in the movement of the wedge drive, that is to say the slider element with respect to the driver element, a firm hold for the two elements against each other is additionally reinforced. The holding bars can additionally have further projecting portions which permit the transmission of forces upon retraction of the slider element, in which case they come into hooking engagement in the driver element and promote a positive return movement.

The transmission of transverse forces and thrusts is effected on the basis of the positively locking connection of the tool fastening device 10 and the slider element 2 to each other as well as the guide prism 14 and the main body 12 of the tool fastening device 10 to each other by way of the guide prism 14 and the driver prism 31 onto which the guide prism 14 is fitted. The main body 12 of the tool fastening device 10 itself is also pressed into the desired position by way of the guide prism 14 so that a force-locking connection is ensured in that region during a workpiece processing operation, that is to say in operation of the wedge drive 1.

As can be seen in particular from FIGS. 2 and 3 assembly and dismantling of the tool fastening device is possible entirely without any problem downwardly in the direction of the driver element 3, the wedge drive 1 involving an upper part wedge drive. That obviates the disadvantage of the state of the art that dismantling of the tool fastening device has to be effected in a direction towards the slider guide element or another element which has little space around it. Rather, the structure according to the invention of the tool fastening device and a correspondingly equipped wedge drive permits assembly and dismantling of the tool fastening device to and from the wedge drive, completely without any problem.

Precise positional determination and positioning accuracy can also be effected for example by peg bores at the sides of the tool fastening device. Such peg bores are provided laterally in the tool fastening device and the slider element of FIG. 1, and denoted by references 18, 23. Those peg bores can in principle also serve for fixing the slider element 2 and the tool fastening device to each other.

By virtue of the provision of the tongue-and-groove connections, that is to say positively locking connections, it is also possible to ensure the desired reproduction accuracy in relation to the location or position of the tool fastening device on the wedge drive or slider element and driver element respectively, that being possible with in accuracy of less than 0.02 mm. Furthermore it is advantageously possible, after dismantling of the tool fastening device, to grip the main body in a suitable workpiece working apparatus and to provide accurately fitting bores for mounting stamping punches, milling cutters and so forth, as the front face and the rearward face of the main body of the tool fastening device are in substantially mutually parallel relationship. That arrangement means that flat gripping and accurately fitting positioning can be implemented entirely without any problem for producing bores for fixing workpiece working tools, also with an extremely high level of reproduction accuracy, so that even after a change in a tool and/or the tool fastening device, very high accuracy demands can still be satisfied.

FIGS. 4, 5 and 6 show a further embodiment of a tool fastening device 200 according to the invention. In this embodiment the main body 212 and the guide prism are of a different configuration from the embodiment shown in FIGS. 1 through 3. In the embodiment illustrated in FIGS. 4, 5 and 6, the main body 212 of the tool fastening device is substantially L-shaped in side view with an upstanding portion 211 and a portion 215 projecting substantially at a right angle therefrom. It has a prismatic recess 213 instead of the angled recess 13. The guide prism is formed by attaching sliding plates 214 to the surfaces of the prismatic recess 213. The embodiment of FIGS. 4 and 5 has two such sliding plates 214. Those sliding plates bear against the driver prism 31. Those sliding plates can be comparatively thin. Additional fixing thereof to the main body 212 is possible by way of clips and/or screws, as indicated by the opening 217 in the main body 212. Any other kind of fixing is also possible between the sliding plates and the main body. Positional determination and positioning of the sliding plates 214 with the desired degree of accuracy is also possible by way of the openings 217. The prismatic recess 213 has a limb 216 extending in the longitudinal direction of the lower portion 215 of the L-shaped main body. The sliding plates 214 adjoin the limb 216. The limb thus also serves for positioning the sliding plates with the desired accuracy. The driver prism 31 can possibly also slide in the central region on that limb 216. It will be noted however that this does not occur in the embodiment shown in FIGS. 4 through 6 as the limb is provided with recesses which could damage the driver prism and thus prevent a movement.

The lower portion 215 of the L-shaped main body, on the side 218 which faces towards the slider element and which is in opposite relationship to the prismatic recess 213, has grooves which however cannot be seen in FIGS. 4 through 6. Projecting limbs 25 on the underside of the slider element 2 engage into those grooves, the limbs 25 being arranged in the longitudinal direction of the projecting portion 215 of the L-shaped main body of the tool fastening device. The two limbs 25 are connected together by a transverse limb 26, thus forming an abutment for the lower portion 215 of the L-shaped main body of the tool fastening device. An intentional movement of the tool fastening device in the transverse direction of the wedge drive can be advantageously prevented by the provision of the interengaging limbs 25 and grooves. A further positively locking connection between the slider element and the main body is possible in the upper region of the main body by a transverse limb 219 projecting there, in combination with the groove 22 in the upper region of the slider element 2. The fastening in this case therefore corresponds to the embodiment shown in FIGS. 1 through 3 of the wedge drive with the tool fastening device. In principle the lower portion 215 of the L-shaped main body forms an attached part of the main body 12 shown in FIGS. 1 through 3. The rest of the fastening by way of holding bars 50, 51 can also be implemented as shown in FIGS. 1 through 3.

Just as in the embodiment shown in FIGS. 1 through 3, in this embodiment as shown in FIGS. 4 through 6 pressing forces which occur upon fitment and during working of a workpiece can be transmitted by way of the guide prism directly to the tool fastening device, thereby affording a stable positive position during the working operation with respect to the tool fastening device. That is again found to be advantageous in terms of accuracy of workpiece machining.

The tool fastening device can be secured to prevent it from falling off the slider element by way of the screws which are inserted from below, that is to say from the side of the driver element, to which the tool fastening device is fitted.

FIGS. 7 through 12 show a further embodiment of a tool fastening device according to the invention in an arrangement on a slider element with a driver element of an upper part wedge drive. The tool fastening device 300 again has an L-shaped main body 312. The L-shaped main body has an upstanding portion 311 and a lower portion 315 arranged transversely relative thereto. In contrast to the arrangement of FIGS. 4 through 6 the upstanding upper portion 311 does not have a projecting limb on its upper side facing towards the projecting portion of the slider element, but rather a recess 319 on that upper side. That recess 319 is surrounded on three sides by edge limbs. A projecting portion 27 of the slider element, for engaging into the recess 319, has a transverse limb 28 which projects in a direction towards the tool fastening device. The transverse limb 28 is advantageously of such a configuration that it fits into the recess 319 in positively locking relationship. The limb can be particularly clearly seen from FIG. 12.

The lower portion 315 is in the form of three longitudinal limbs 316, 317, 318. The longitudinal limbs are fastened by way of screw connections on the underside 29 of the slider element 2. For that purpose both the longitudinal limbs and also the underside of the slider element have bores or through openings, into which screws can be fitted.

The longitudinal openings 313, 314 formed between the central longitudinal limb 317 and the outer longitudinal limbs 316, 318 are of such a configuration that prism portions 320, 321 can be inserted there. After assembly of the wedge drive the prism portions 320, 321 are seated on the driver prism 31. They are connected to the main body of the tool fastening device by way of screws or by a clamping connection or another suitable connection. Adaptation to different widths of the slider element and/or driver element or the driver prism can be effected by altering the widthwise extent and the longitudinal extent of the main body and the prism portions. That can also already be seen from FIGS. 7 through 12 illustrating tool fastening devices and prism portions, of differing widths. In that case the prism portions can have flanks of differing steepness in order to be adapted to the given factors of the driver prism.

As can be seen from FIGS. 10 through 12 the prism portions 320, 321 can project beyond the outside front extent of the main body 312. If however the tool which is to be mounted to the outside of the tool fastening device is impeded thereby, it is in principle also possible for the outside surfaces of the prism portions 320, 321 and the main body 312 to be aligned with each other.

FIGS. 13 through 17 show a further embodiment of an upper part wedge drive equipped with a tool fastening device 400 according to the invention. This upper part wedge drive differs from that shown in FIGS. 1 through 3 in that the driver element 430 is not provided with an inclinedly arranged driver prism, but with a substantially horizontally arranged driver prism 431. Accordingly the slider element 420 is also shaped in such a way that a sliding movement is possible on the substantially horizontally arranged driver prism. For that purpose the slider element has a portion 428 which is longer in a direction towards the driver element. The prolonged portion embraces the guide prism of the tool fastening device on three sides. That provides for a rearward holding action for the guide prism 414, in the driving direction. The guide prism is otherwise fixed in a manner corresponding to the configuration in FIGS. 1 through 3, to the slider element. The main body 412 of the tool fastening device is fastened to the slider element 420 by way of lateral grooves 410, 411, wherein the slider element has correspondingly projecting limbs 422, 423 and grooves 424, 425 in the longitudinal direction, into which correspondingly projecting portions 408, 409 of the main body engage. That also permits the main body of the tool fastening device to be fastened to the slider element in positively locking relationship and in force-transmitting relationship. The guide prism 414 can be fastened to the slider element and the main body by way of screws, corresponding to the embodiment shown in FIGS. 1 through 3.

Besides the embodiments of wedge drives and tool fastening devices for same, which have been described hereinbefore and illustrated in the Figures, it is also possible to envisage numerous other configurations, in each of which there is a positively locking and/or force-locking connection between the tool fastening device and the slider and driver elements. In particular it is also possible to design hybrid forms of the tool fastening devices illustrated in the Figures, in dependence on the respective desired use.

LIST OF REFERENCES

1 wedge drive
2 slider element
3 driver element
4 slider guide element
5 guide clamp
10 tool fastening device
11 projecting element of the tongue-and-groove connection
12 main body
13 recess
14 guide prism
15 screw
16 screws
17 through opening
18 opening
19 front face
20 rearward side
21 front side
22 groove
23 peg bore
24 recess
25 projecting limb
26 projecting transverse limb
27 projecting portion
28 transverse limb
29 underside
31 driver prism
32 region
50 holding bar
51 holding bar
52 projecting end
53 projecting end
200 tool fastening device
211 portion
212 main body
213 prismatic recess
214 sliding plate
215 portion
216 limb
217 through opening/recess
218 side
219 transverse limb
300 tool fastening device
311 upstanding portion
312 main body
313 longitudinal opening
314 longitudinal opening
315 lower portion
316 longitudinal limb
317 longitudinal limb
318 longitudinal limb
319 recess
320 prism portion
321 prism portion
400 tool fastening device
408 portion
409 portion
410 groove
411 groove
412 main body
414 guide prism
420 slider element
422 limb
423 limb
424 groove
425 groove
428 portion
430 driver element
431 driver prism

The invention claimed is:

1. An upper part wedge drive comprising:

a slider element;

a slider guide element operably connected to the slider element for the slider element to be capable of moving relative to the slider guide element in a working direction to position the upper part wedge drive in a working position;

a driver element operably connected to the slider element for the slider element to be capable of moving relative to the driver element in the working direction to position the upper part wedge drive in the working position, wherein at least one of the slider guide element or the driver element is configured to move along a substantially vertical direction to position the upper part wedge drive in the working position, wherein the working direction is not in the substantially vertical direction, and wherein the slider element is between the slider guide element and the driver element along the substantially vertical direction; and a tool fastening device with at least one tool mounting surface, the tool fastening device forming a first positive locking connection with the slider element and a second positive locking connection with the driver element, the second positive locking connection comprising a coupling mechanism configured to accept a fastener in a fastening direction generally perpendicular to the working direction of the wedge drive, wherein the fastening direction is in a plane formed by the substantially vertical direction and the working direction, and wherein the tool fastening device is fastened dismantleably downwardly in relation to the upper part wedge drive in the working position thereof.

2. An upper part wedge drive as set forth in claim 1, wherein the tool fastening device is dismantleable at an angle oriented generally perpendicular relative to the working direction of the wedge drive.

3. An upper part wedge drive as set forth in claim 1, wherein the wedge drive has at least one portion which faces towards the tool fastening device and carries return traction forces, and has at least one connecting device for positively lockingly connecting to the tool fastening device.

4. An upper part wedge drive as set forth in claim 1, wherein the tool fastening device is fixable to the wedge drive by way of at least one fastener that configured to be inserted into the tool fastening device on a side towards which the tool fastening device can be removed from the wedge drive.

5. An upper part wedge drive as set forth in claim 1, wherein the tool fastening device comprises at least one guide prism for support on a driver prism.

6. An upper part wedge drive as set forth in claim 5, wherein the at least one guide prism and a main body of the tool fastening device are integrally formed from a continuous piece of material.

7. An upper part wedge drive as set forth in claim 5, wherein the tool fastening device comprises a prismatic recess having surfaces onto which sliding plates are attached to form the at least one guide prism.

8. An upper part wedge drive as set forth in claim 5, further comprising at least one lateral holding bar element on a side of the slider element, the at least one lateral holding bar element extending beyond a region of the at least one guide prism to the driver element for providing the wedge drive with stability against high mass acceleration forces.

9. An upper part wedge drive as set forth in claim 8, wherein at least one holding bar element engages laterally at or under the driver element.

10. An upper part wedge drive as set forth in claim 9, wherein the at least one holding bar comprises one or more holding noses for engaging with the driver element to enhance the transmission of forces thereto when the slider element is pulled back.

11. An upper part wedge drive as set forth in claim 1, wherein the tool fastening device is of an L-shaped configuration in one or more parts.

12. A tool fastening device for a wedge drive having a slider element, a slider guide element and a driver element, the tool fastening device comprising:

at least one lateral surface generally perpendicular to a working direction of the wedge drive; and at least one connecting device for positively lockingly connecting to the driver element, the at least one connecting device configured to accept a fastener in a fastening direction generally perpendicular to the working direction of the wedge drive, wherein the slider guide element is configured to operably connect to the slider element for the slider element to be capable of moving relative to the slider guide element in the working direction to position the wedge drive in a working position, and wherein the driver element is configured to operably connect to the slider element for the slider element to be capable of moving relative to the driver element in the working direction to position the wedge drive in the working position, wherein at least one of the slider guide element or the driver element is configured to move along a substantially vertical direction to position the wedge drive in the working position, wherein the working direction is not in the substantially vertical direction, and wherein the fastening direction is in a plane formed by the substantially vertical direction and the working direction.

13. A tool fastening device as set forth in claim 12, wherein the tool fastening device comprises at least one surface which is substantially parallel to the at least one lateral surface thereof.

14. A tool fastening device as set forth in claim 12, wherein the connecting device is further configured to provide a force-locking connection, the force-locking connection of the connecting device comprising at least one guide prism provided on a side of the tool fastening device.

15. A tool fastening device as set forth in claim 14, wherein at least one guide prism and a main body of the tool fastening device are formed integrally of a continuous piece of material.

16. A tool fastening device as set forth in claim 14, wherein the at least one guide prism and a main body of the tool fastening device are connectable together by at least one fastener.

17. A tool fastening device as set forth in claim 12, wherein the connecting device for positively locking connection is a tongue-and-groove connection.

18. An upper part wedge drive as set forth in claim 1, wherein the first positive locking connection is provided by a tongue-in-groove structure formed on the tool fastening device and the slider element.

19. An upper part wedge drive comprising:

a slider element;

a slider guide element operably connected to the slider element for the slider element to be capable of moving relative to the slider guide element in a working direction to position the upper part wedge drive in a working position;

a driver element operably connected to the slider element for the slider element to be capable of moving relative to the driver element in the working direction to position the upper part wedge drive in the working position, wherein at least one of the slider guide element or the driver element is configured to move along a substantially vertical direction to position the upper part wedge drive in the working position, wherein the working direction is not in the substantially vertical direction, and wherein the slider element is between the slider guide element and the driver element along the substantially vertical direction; and a tool fastening device with at least one tool mounting surface, the tool fastening device comprising a first connection device for engaging with a second connecting device of the slider element in a direction transverse to the working direction of the tool fastening device to form a positive locking connection with the slider element when the tool fastening device is in an assembled position and a fastening connection on a side of the tool fastening device towards which the tool fastening device is configured to be removed from the wedge drive, the fastening connection configured to accept a fastener in a fastening direction generally perpendicular to the working direction of the wedge drive, wherein the fastening direction is in a plane formed by the substantially vertical direction and the working direction, and the tool fastening device being supported between the slider element and the driver element in the assembled position such that opposing forces transmitted from the slider element and the driver element and the positive locking connection with the slider element aid in maintaining the tool fastening device in the assembled position, the tool fastening device being configured to be separated from the slider element in a direction transverse to the working direction of the tool fastening device.

20. A tool fastening device as set forth in claim 19, wherein the first connecting device of the tool fastening device comprises at least one of a groove and a projection, and the second connecting device of the slider element comprises at least one of a groove and a projection.

* * * * *